US007467489B2

(12) United States Patent
Gussalli Beretta

(10) Patent No.: US 7,467,489 B2
(45) Date of Patent: Dec. 23, 2008

(54) PISTOL WITH INTERCHANGEABLE GRIP

(75) Inventor: Ugo Gussalli Beretta, Gardone val Trompia (IT)

(73) Assignee: Fabbrica d'Armi Pietro Beretta S.p.A., Brescia (IT)

( * ) Notice: Subject to any disclaimer, the term of this patent is extended or adjusted under 35 U.S.C. 154(b) by 153 days.

(21) Appl. No.: 11/311,431

(22) Filed: Dec. 19, 2005

(65) Prior Publication Data

US 2006/0162222 A1 Jul. 27, 2006

(30) Foreign Application Priority Data

Dec. 22, 2004 (IT) ..... MI2004A2449

(51) Int. Cl.
*F41C 23/10* (2006.01)

(52) U.S. Cl. ..... 42/72

(58) Field of Classification Search ..... 42/71.02, 42/72

See application file for complete search history.

(56) References Cited

U.S. PATENT DOCUMENTS 4,333,256 A * 6/1982 Hogue ..... 42/71.02
4,342,170 A * 8/1982 Hogue et al. ..... 42/71.02
4,520,585 A * 6/1985 Barrett ..... 42/7
4,570,370 A * 2/1986 Smith et al. ..... 42/90
4,593,487 A * 6/1986 Ruger et al. ..... 42/7
4,625,445 A 12/1986 Ruger
4,936,036 A 6/1990 Sniezak et al.
5,050,329 A * 9/1991 Hogue et al. ..... 42/71.02
5,231,237 A 7/1993 Cupp
5,621,997 A * 4/1997 Pearce ..... 42/71.02
5,632,108 A * 5/1997 Ruger et al. ..... 42/1.01
5,768,817 A * 6/1998 Simons ..... 42/71.02
6,073,381 A * 6/2000 Farrar et al. ..... 42/71.02
6,112,446 A * 9/2000 Forster et al. ..... 42/71.02
6,427,338 B1 * 8/2002 Schmidt ..... 30/232
6,430,860 B1 * 8/2002 Constant et al. ..... 42/84

FOREIGN PATENT DOCUMENTS

DE 290 363 C 2/1916
EP 0 729 004 A 8/1996
JP 06023678 A * 2/1994

OTHER PUBLICATIONS

European Search Report.

* cited by examiner

*Primary Examiner*—Troy Chambers
(74) *Attorney, Agent, or Firm*—James V. Costigan; Hedman & Costigan, P.C.

(57) ABSTRACT

A pistol with interchangeable grip comprising a frame (12) adapted to receive an interchangeable grip (13), in which engagement means for the locking and release of the grip are arranged coupled to the frame (12) and to the grip (13) and comprise a pin or peg (20), moveable within a seat (21) of the frame (12) from a first position of engagement in a seat (23) formed on an inner surface of a side wall (13A) of the grip (13) to a second position disengaged from this.

8 Claims, 4 Drawing Sheets

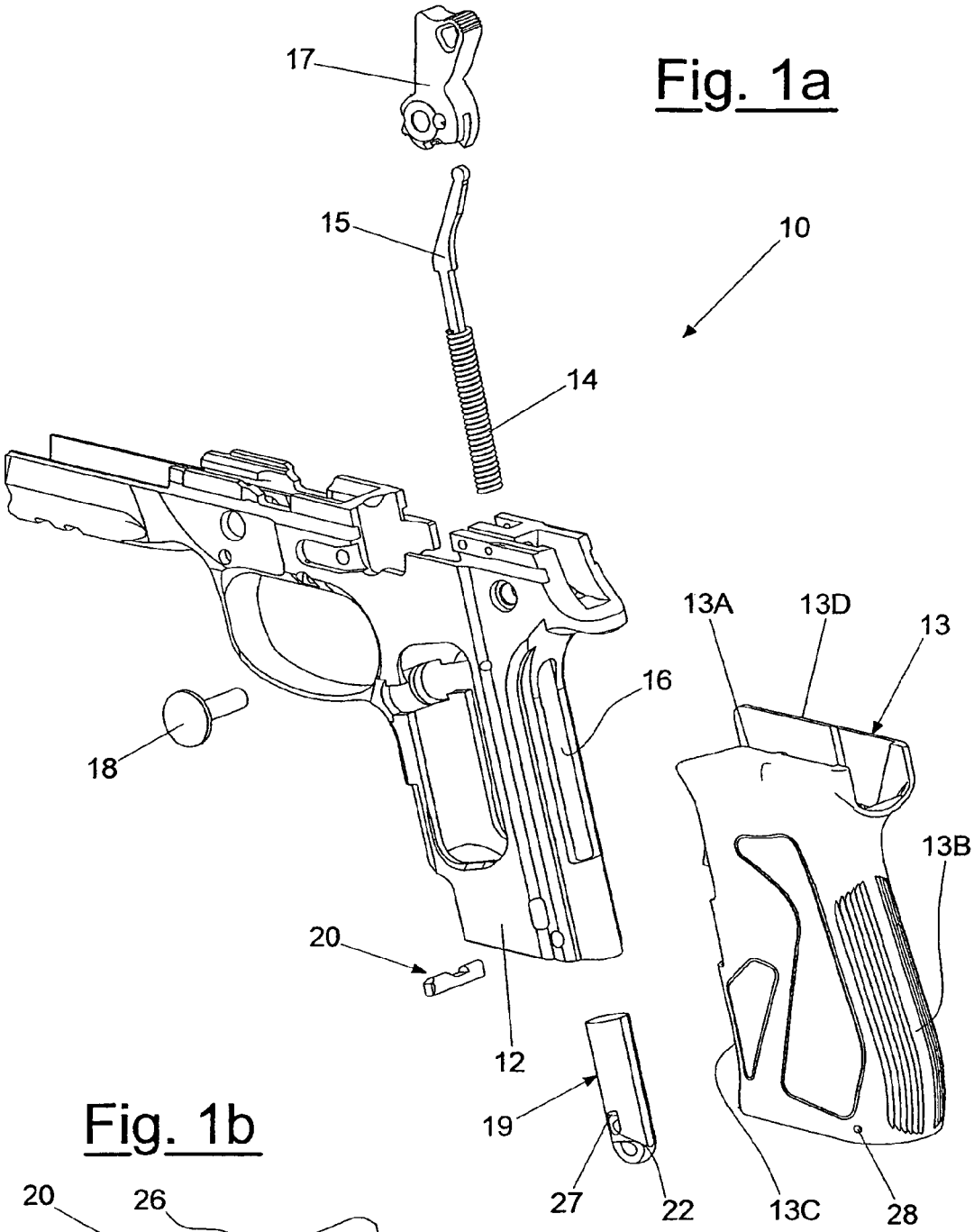
Fig. 1a
Fig. 1b
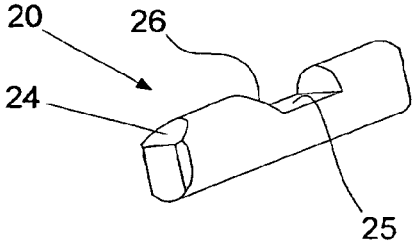

PISTOL WITH INTERCHANGEABLE GRIP

The present invention refers to a pistol with interchangeable grip.

Pistols may be provided, according to that known, with protection elements called grips, screwed onto opposite sides of the frame. The grips, for example realised in wood, plastic material or in other materials, permit the shooter to have a good hold on the frame. To such purpose, the grips are appropriately shaped and equipped with knurlings or other elements which improve the shooter's hold.

The above described grips may be dismantled from the pistol frame for their substitution or for the weapon cleaning. Nevertheless, this operation requires the user to operate on two screws for each grip and therefore to employ adapted tools. Furthermore, the substitution of the grips requires a relatively high operation time, since several operations must be carried out.

Object of the present invention is that of realising a pistol with interchangeable grip in which the substitution of the grip takes place in a simple and quick manner.

Further object is that of realising a pistol with interchangeable grip with a reduced number of components, which reduces the logistical engagement and handling of the replacement parts.

Another object of the present invention is that of realising a pistol with interchangeable grip which provides the user with excellent comfort and an optimal grip.

One other object is that of realising a pistol with interchangeable grip which thanks to the modular structure of the system permits the user to choose the most adapted grip in terms of shape and material.

These objects according to the present invention are achieved by realising a pistol with interchangeable grip as set forth in claim 1.

Further characteristics are foreseen in the dependent claims.

The characteristics and advantages of a pistol with interchangeable grip according to the present invention will be more evident from the following exemplifying and not limiting description, referred to the attached schematic drawings, wherein:

FIG. 1*a* is an exploded view of a pistol with interchangeable grip according to the present invention;

FIG. 1*b* shows an enlarged detail of FIG. 1*a;*

Figure 3:
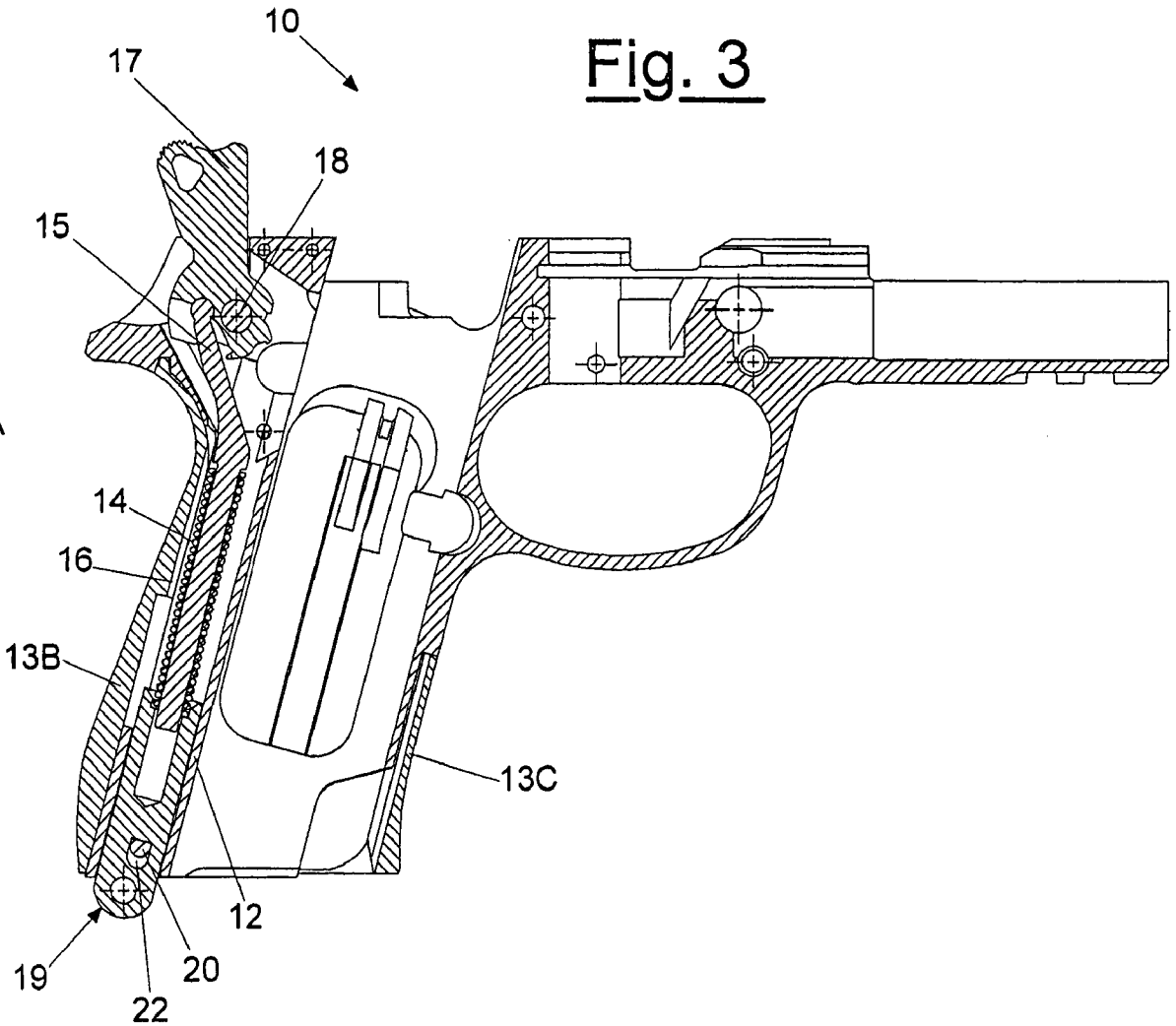
FIG. 3 is a section view of the pistol of FIG. 2 along to the plane of trace III-III.

With reference to the figures, a pistol with interchangeable grip is shown, indicated in its entirety with 10 and comprising a frame 12 adapted to receive a grip 13. The frame 12 comprises, in the example shown, a hammer spring 14 fit on a spring guide element or rod 15 housed in a cavity 16 inside the frame 12. The spring guide rod 15 is placed in engagement with one of its upper ends with a hammer 17, moveable in rotation around a pin 18, as shown in FIGS. 1*a* and 3.

At the opposite end, the rod 15 is inserted in a frame cap 19, which closes the cavity 16 on its lower end, and on which a lower end of the hammer spring 14 is placed in abutment.

Figure 2:
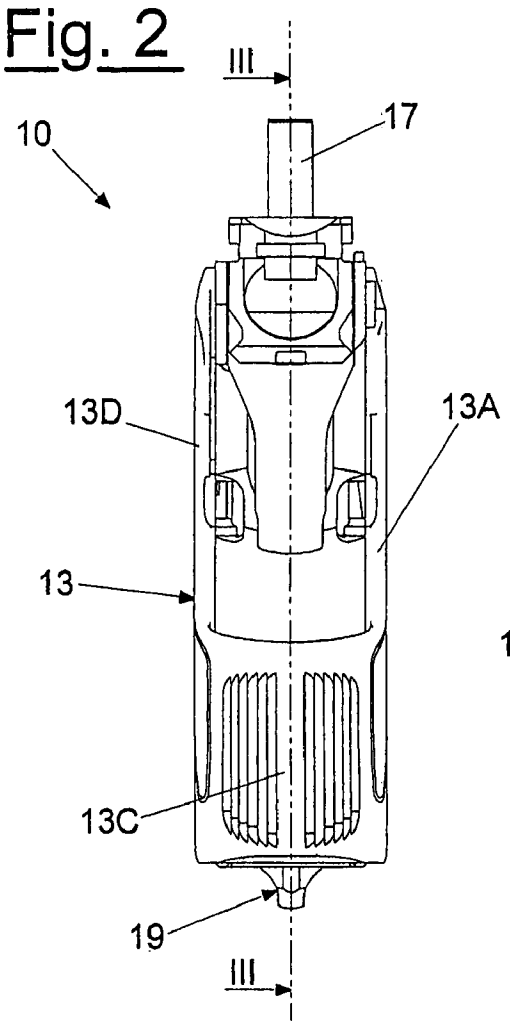
FIG. 2 is a front elevation view of the pistol according to the invention.
Figure 4:
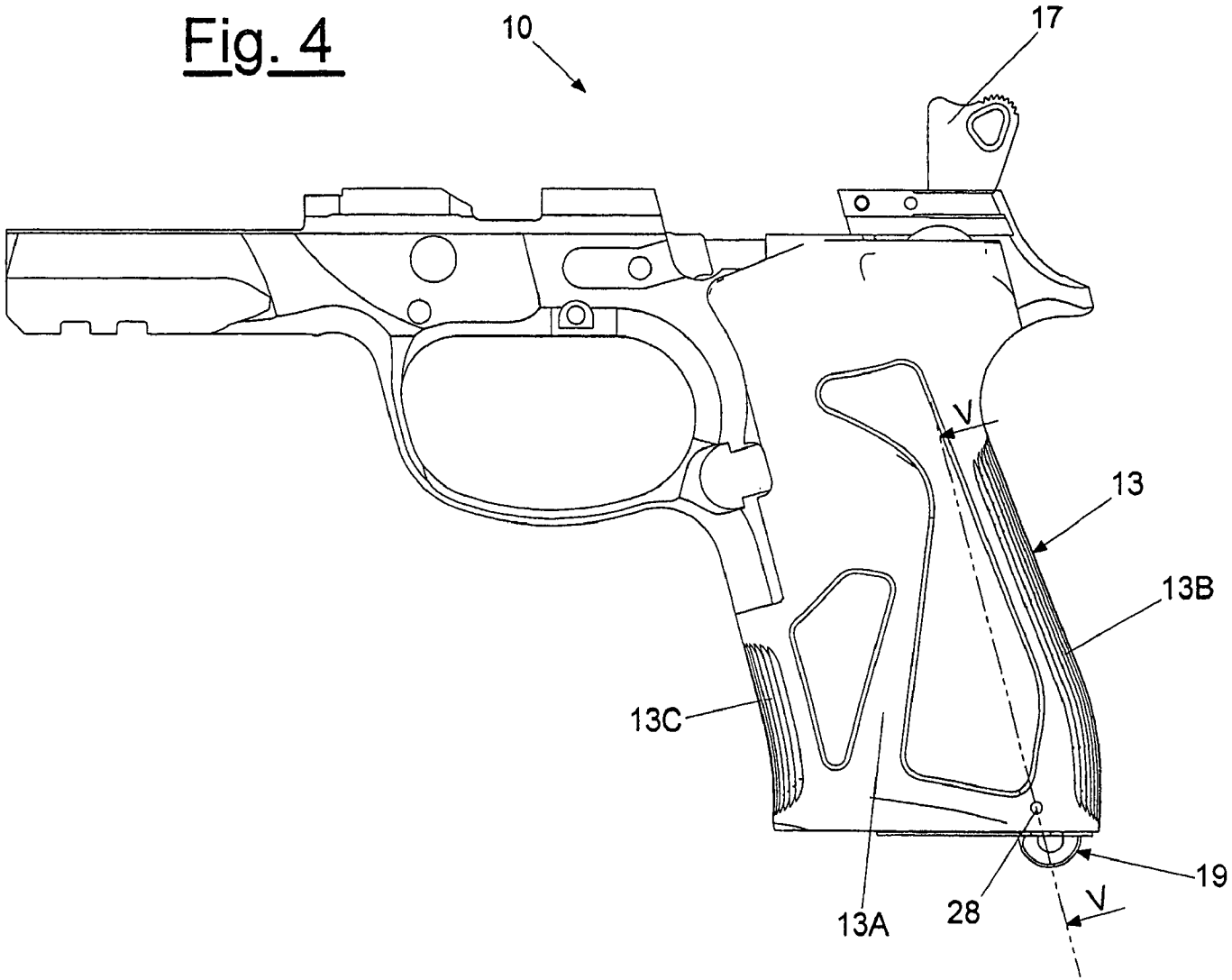
FIG. 4 is a side elevation view of the pistol with interchangeable grip, object of the present invention.

The interchangeable grip 13, according to the shown embodiment, has tubular form and is adapted to externally enclose the frame. The grip 13 of sleeve form comprises, in the shown example, two opposite side walls 13A and 13D and a rear wall 13B extended substantially along the entire height of the frame 12. A lowered front wall 13C, as shown in FIG. 2, has instead a reduced height and encloses the frame 12 in the lower portion. The interchangeable grip according to further, not shown embodiments may also be shaped differently.

Engagement means adapted to operate on both the frame 12 and the grip 13 realise the locking (FIG. 5) and release (FIG. 6) of the grip 13.

In particular, a pin or peg 20 is arranged within a seat 21 of the frame 12, for example a transverse through hole of the frame 12 as well as within a through hole 22 of the frame cap 19, and is moveable from a first position of engagement in a seat 23 formed on the inner surface of a side wall 13A of the grip to a second position disengaged from this.

The pin 20, shown in the enlarged detail of FIG. 1*b*, comprises an inclined plane 24 at one end, descending toward the same end, as well in a lowered central portion 25 a second inclined plane 26, opposite the first inclined plane 24.

The pin 20, or rather its shaped profile, is coupled, in locked grip 13 conditions, to an elastic contrast member, or rather to the frame cap 19 loaded by the hammer spring 14, which operates with a push in the direction orthogonal to the through hole 21 of the frame. An upper part of the hole 22 of the frame cap 19 is, indeed, shaped in a complementary manner to the lowered portion 25 of the pin 20 in order to realise a stable coupling in locked grip 13 conditions, and has in particular an inclined plane 27 complementary to the second inclined plane 26 of the pin 20.

The seat 23 of the side wall 13A of the grip 13 also has an inclined plane and it is complementary to the end of the pin 20 equipped with the inclined plane 24. The coupling between grip 13 and frame 12 realised by means of two inclined planes 24 and 26 of the locking pin 20 permits recovering the clearances which form following the wear of the mechanical parts during the use of the weapon.

Figure 6:
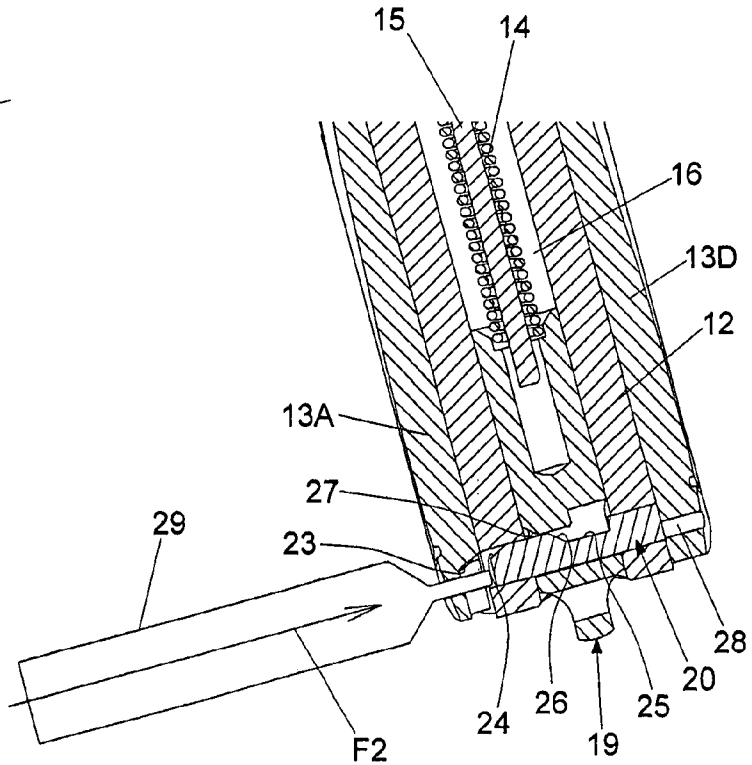
FIGS. 5 and 6 show an enlarged section detail of the pistol according to the present invention, sectioned along a plane V-V of FIG. 4, respectively during the locking operation of the grip and during the release operation of the same.
Figure 5:
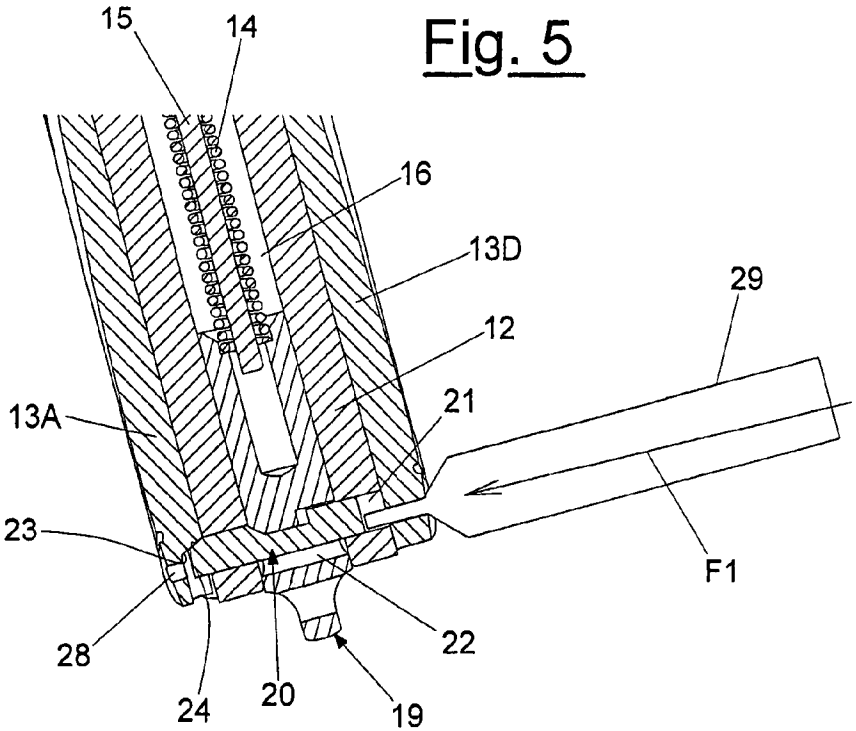

The grip 13 has two opposing holes 28 aligned with the through hole 21 of the frame in mounted grip conditions, as shown in the sections of FIGS. 5 and 6. Through the holes of the grip 28, the user operates by means of a pointed tool 29 on the engagement pin 20, respectively for the locking and release of the grip 13.

According to that shown in FIG. 5, in order to lock the grip 13 after having fit it on the frame 12, the pin 20, which is initially contained within the hole 21 of the frame, according to that shown in FIG. 6, is pushed in the direction of the arrow F1, for example with the punch 29 introduced through the hole 28 of the grip 13. When locked, the first 24 and second 26 inclined plane of the pin 20 are respectively coupled with the seat 23 in the wall 13A of the grip 13 and with the shaped part of the hole 22 of the frame cap 19, respectively bearing complementary inclined planes. The frame cap 19, which in this position is pushed downward by the hammer spring 14, stably maintains the engagement pin 20 in position.

To release the grip 13, it is instead necessary to overcome the contrast action of the hammer spring 14, pushing the lower end of the frame cap 19 upward. Then, holding the cap 19 pressed, the pin 20 is moved in the opposite direction, along the arrow F2 of FIG. 6, acting through the opposite hole 28 of the grip 13, in order to disengage it from the seat 23.

The grip 13, in the released position of FIG. 6, may be freely taken off from the frame 12.

Alternatively to that shown and described, even only a single hole 28 may be foreseen, through which the pin 20 may be alternately moved between locking position of the grip 13 and the release position of the same through an appropriate tool.

Furthermore, the elastic contrast member, which in the realisation shown in the figures is composed of the hammer spring 14, could also be an additional spring dedicated to the locking and release of the grip, or any other spring already present in the weapon.

The pistol with interchangeable grip, object of the present invention, has the advantage of permitting a quick execution of the locking and release operations of the grip, even without the aid of specific tools. The mounting of different types of grips adapted to user needs is therefore advantageously favoured.

The pistol with interchangeable grip thus conceived is susceptible to numerous modifications and variations, all coming under the invention; furthermore, all of the details may be substituted with technically equivalent elements. In practice, the materials utilised, as well as the dimensions, may be of any type according to the technical needs.

The invention claim is:

1. Pistol with interchangeable grip comprising a frame (12) , adapted to receive an interchangeable grip (13), said interchancable grip (13) comprising engagement means for the locking and the release of said interchangeable grip (13), wherein said engagement means are coupled to said frame (12) and said interchangeable grip (13) and wherein said engagement means comprise a pin (20) and an elastic member acting on said pin (20) in a direction orthogonal to a seat (21) of said frame (12), wherein said pin (20) is arranged within a seat (21) and is movable from a first position of engagement in a seat (23) formed on an inner surface of a side wall (13A) of said grip (13) to a second position disengaged therefrom, wherein said pin (20) comprises at one end, a first inclined plane (24) which descends toward an end for engagement in said seat of said grip (23), said seat of said grip (23) being complementary to said first inclined plane (24), and said pin (20) further comprising a lowered central portion (25) which is bound at one end by a second inclined plane (26), arranged at an angle which is opposite the angle of said first inclined plane (24), said elastic member having a hole (22) shaped in a complementary manner to said lowered central portion (25) of the pin (20) and comprises an additional inclined plane (27) for a stable coupling with said second inclined plane (26) of the pin (20) when said pin (20) is in locked grip conditions under a push of said elastic member.

2. Pistol according to claim 1, wherein said elastic member comprises a frame cap (19) of the frame (12), on which a spring (14) is placed in abutment, in which said frame cap (19) has a through hole (22) for said engagement pin (20).

3. Pistol according to claim 2, wherein said spring (14) is a hammer spring applied to a spring guide element or rod (15).

4. Pistol according to claim 1, wherein said seat (21) of the frame (12) is a transverse through hole.

5. Pistol according to claim 1, wherein said grip (13) has at least one hole (28) for the operation on said engagement pin (20), which may be aligned with said through hole (21) of the frame in mounted grip conditions.

6. Pistol according to claim 5, wherein said at least one hole (28) are two opposing holes (28) for the operation on said engagement pin (20) respectively for the locking and release of said grip (13).

7. Pistol according to claim 1, wherein said interchangeable grip (13) has tubular form and is adapted to externally enclose said frame (12).

8. Pistol according to claim 7, wherein said grip (13) comprises two opposing side walls (13A and 13D) and a rear wall (13B) substantially extended along the entire height of the frame (12), as well as a lowered front wall (13C).

* * * * *